US009229415B2

(12) United States Patent
Ueno

(10) Patent No.: US 9,229,415 B2
(45) Date of Patent: Jan. 5, 2016

(54) IMAGE FORMING APPARATUS

(71) Applicant: KYOCERA Document Solutions Inc., Osaka (JP)

(72) Inventor: Daijiro Ueno, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/601,325

(22) Filed: Jan. 21, 2015

(65) Prior Publication Data

US 2015/0212474 A1 Jul. 30, 2015

(30) Foreign Application Priority Data

Jan. 24, 2014 (JP) ..... 2014-011115

(51) Int. Cl.
*G03G 15/00* (2006.01)
*G03G 21/16* (2006.01)
*G03G 21/18* (2006.01)

(52) U.S. Cl.
CPC ..... *G03G 15/757* (2013.01); *G03G 21/1647* (2013.01); *G03G 21/1864* (2013.01); *G03G 2221/1654* (2013.01)

(58) Field of Classification Search
CPC ..... G03G 15/757; G03G 21/1647; G03G 21/1864
USPC ..... 399/13, 111, 107, 167
See application file for complete search history.

(56) References Cited

U.S. PATENT DOCUMENTS 7,392,004 B2 6/2008 Sato et al.
7,715,756 B2 * 5/2010 Hattori ..... 399/119

FOREIGN PATENT DOCUMENTS

JP 2006-011283 A 1/2006
JP 2006-162998 A 6/2006

* cited by examiner

*Primary Examiner* — Hoang Ngo
(74) *Attorney, Agent, or Firm* — Studebaker & Brackett PC

(57) ABSTRACT

An image forming apparatus includes an incorrect attachment or detachment preventing mechanism configured to prevent attachment and detachment of the image forming unit in the transmission state. The incorrect attachment and detachment preventing mechanism includes a locking member capable of moving to a restrict position where the locking member restricts movement of the image forming unit from the predetermined position and a permission position where the locking member permits movement of the image forming unit from the predetermined position. In the transmission state, the locking member is configured to engage with the first engaging part of the manual lever at the restrict position to prevent movement of the image forming unit. In the transmission release state, the locking member is configured to be moved to the permission position and then engaged with the second engaging part of the manual lever to permit movement of the image forming unit.

8 Claims, 19 Drawing Sheets

IMAGE FORMING APPARATUS

INCORPORATION BY REFERENCE

This application is based on and claims the benefit of priority from Japanese Patent application No. 2014-011115 filed on Jan. 24, 2014, the entire contents of which are incorporated herein by reference.

BACKGROUND

The present disclosure relates to an image forming apparatus including an attachable/detachable image forming unit.

In an image forming apparatus such as a printer or a multifunction peripheral, there is a construction that an image forming unit such as a photosensitive drum or a development device is attachably/detachably provided at an apparatus main body, and a driving source which drives the image forming unit is provided at the apparatus main body. Such a construction requires a mechanism which transmits a rotation force of the driving source to the image forming unit attached to the apparatus main body.

As a mechanism which transmits the rotation force of the driving source to the image forming unit, there is employed a gear transmission manner of engaging a gear provided at the image forming unit and a gear provided at a driving shaft of the driving source or a coaxial driving transmission manner which coaxially couples the driving shaft of the image forming unit and the driving shaft of the driving source with each other by employing a joint member. In recent years, the coaxial driving transmission manner has become mainstream owing to advantages that space saving can be achieved on the image forming unit side, heating can be restricted, and gear phase alignment can be achieved on the apparatus main body side in the photosensitive drum or the like.

Incidentally, at the time of carrying out replacement or maintenance of the image forming unit, a serviceman or a user attaches or detaches the image forming unit, and however, if the image forming unit is not attached at a normal position under a predetermined operating environment, a malfunction or a damage of the image forming apparatus can occur. In particular, in the coaxial driving transmission manner, in a case where the image forming unit is attached or detached in a direction orthogonal to the driving shaft of the driving source, if the image forming unit is incorrectly attached, the driving shaft of the image forming unit and the driving shaft of the driving source interfere with each other, and a coupling part of the driving shafts may be damaged.

In order to prevent incorrect attachment of the image forming unit, there is an image forming apparatus configured so that if the image forming unit is incorrectly attached, the attached posture is apparently clearly different from a normal attached posture. Also, there is an image forming apparatus in which, in a case where the image forming unit is incorrectly attached, a handle for unmovably fixing the image forming unit to the image forming apparatus is made inactive.

However, these image forming apparatuses both cause a user to recognize incorrect attachment after the image forming unit has been incorrectly attached, and it is not an essential measure for solving a problem such as damage occurred at the time of incorrect attachment.

SUMMARY

In accordance with an embodiment of the present disclosure, an image forming apparatus includes an image forming unit, a rotation force transmission mechanism, a manual lever and an incorrect attachment and detachment preventing mechanism. The image forming unit is attachable to or detachable from a predetermined position. The rotation force transmission mechanism is configured to transmit a rotation force from a driving source to the image forming unit. The manual lever is configured to switch the rotation force transmission mechanism into a transmission state in which the rotation force transmission mechanism is coupled to the image forming unit and a transmission release state in which the rotation force transmission mechanism is spaced away from the image forming unit. The incorrect attachment or detachment preventing mechanism is configured to prevent attachment and detachment of the image forming unit in the transmission state. The incorrect attachment and detachment preventing mechanism includes a locking member capable of moving to a restrict position where the locking member restricts movement of the image forming unit from the predetermined position and a permission position where the locking member permits movement of the image forming unit from the predetermined position. The manual lever is formed with a first engaging part configured to engage with the locking member at the restrict position and a second engaging part configured to engage with the locking member at the permission state. When the manual lever switches the rotation force transmission mechanism into the transmission state, the locking member is configured to engage with the first engaging part of the manual lever at the restrict position to prevent movement of the image forming unit. When the manual lever switches the rotation force transmission mechanism into the transmission release state, the locking member is configured to be moved to the permission position and then engaged with the second engaging part of the manual lever to permit movement of the image forming unit.

The above and other objects, features, and advantages of the present disclosure will become more apparent from the following description when taken in conjunction with the accompanying drawings in which a preferred embodiment of the present disclosure is shown by way of illustrative example.

BRIEF DESCRIPTION OF THE DRAWINGS

FIG. 17A, FIG. 17B, and FIG. 17C are front views each showing the wire cover and the manual lever of the incorrect attachment or detachment preventing mechanism of the color printer according to an embodiment of the present disclosure, wherein FIG. 17A shows a state in which the locking member is positioned at a restrict position, FIG. 17B shows a state in which the manual lever is pulled up in a state in which the locking member is positioned at the restrict position, and FIG. 17C shows a state in which the locking member is moved to a permission position.

FIG. 18A shows the pressing member at a pressing-impossible posture, and FIG. 18B shows the pressing member at a pressing-possible posture.

DETAILED DESCRIPTION

In the following, with reference the drawings, an image forming apparatus according to an embodiment of the present disclosure will be described.

Figure 1:
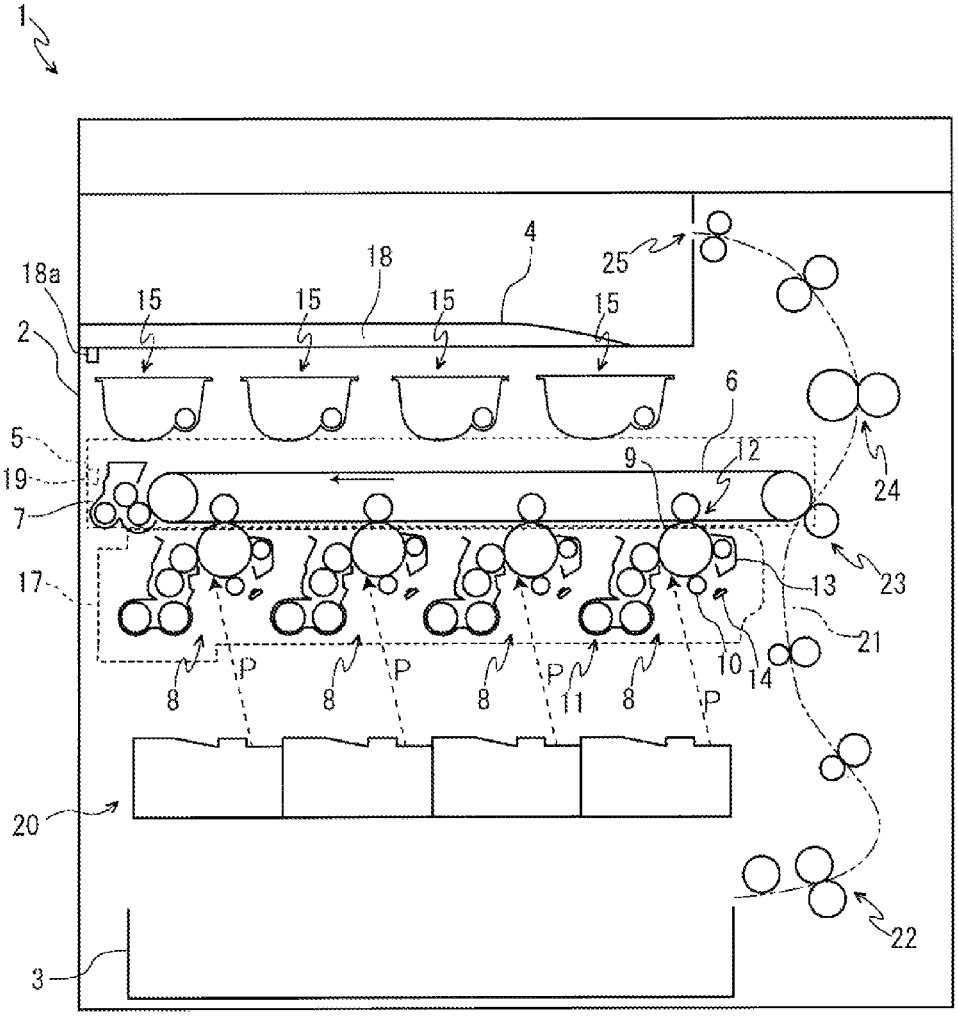
FIG. 1 is a front view schematically showing an entire construction of a color printer according to an embodiment of the present disclosure.
Figure 2:
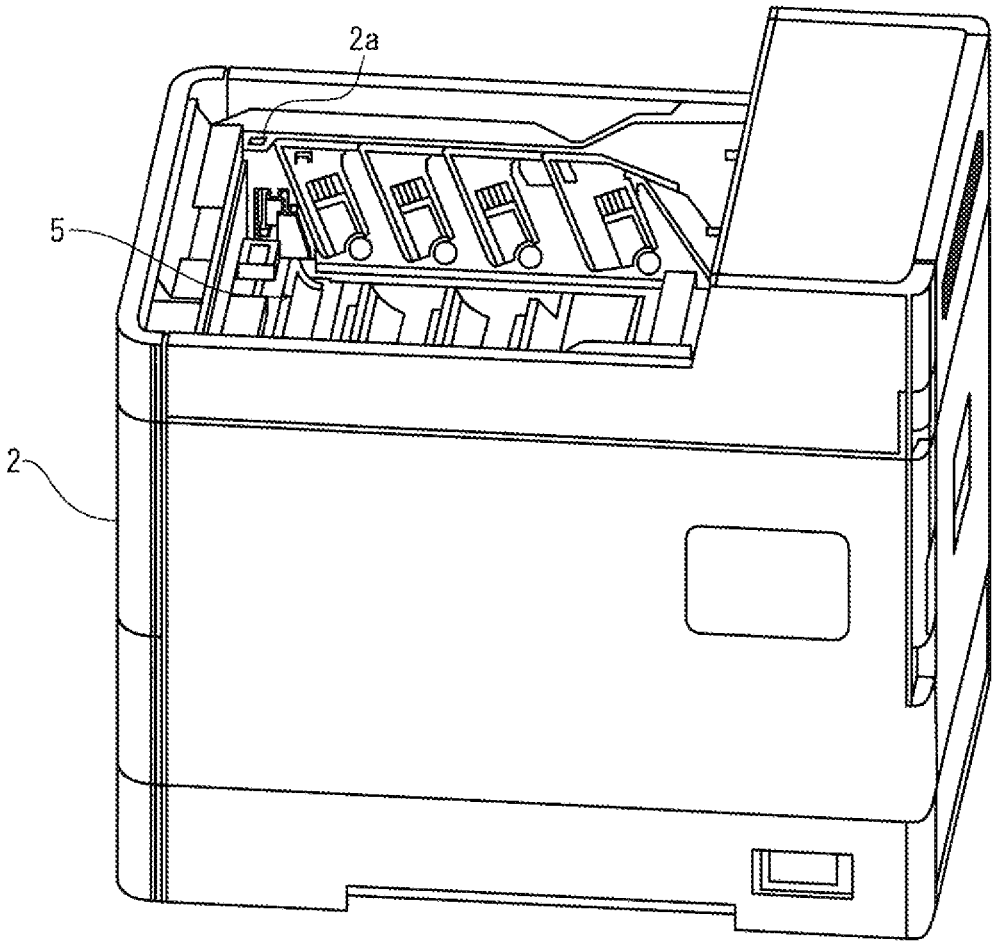
FIG. 2 is a perspective view showing the color printer with an opened top cover according to an embodiment of the present disclosure.

First, with reference to FIGS. 1 and 2, the entire structure of a color printer 1 (an image forming apparatus) will be described. FIG. 1 is a schematic diagram schematically showing the structure of the color printer according to the embodiment of the present disclosure. FIG. 2 is a perspective view showing the color printer with an opened top cover (the top cover is not shown). A near side on FIG. 1 indicates a front side of the color printer 1 and the left and right directions are shown based on a direction viewed the color printer 1 from the front side.

The color printer 1 includes a box-formed printer main body 2. In a lower part of the printer main body 2, a sheet feeding cartridge 3 storing sheets (recording media) is installed and, in an upper part of the printer main body 2, an ejected sheet tray 4 is provided.

In a center part of an inside of the printer main body 2, an intermediate transferring unit 5 is arranged. The intermediate transferring unit 5 has an intermediate transferring belt 6 bridged between a plurality of rollers and a cleaning unit 7 arranged on a left side of the intermediate transferring belt 6. Below the intermediate transferring unit 5, four image forming parts 8 (image forming unit) are installed for respective toner colors (for example, four colors of magenta, cyan, yellow and black). Since the above-mentioned four image forming parts 8 have the similar configuration, one of the four image forming parts 8 will be described. In the image forming part 8, a photosensitive drum 9 is rotatably attached. Around the photosensitive drum 9, a charger 10, a development device 11, a first transferring part 12, a cleaning device 13 and a static eliminator 14 are located in a process order of first transferring.

The photosensitive drum 9 and the developing device 11 are arranged so that their rotating shafts extend in the forward and backward directions of the printer main body 2. The photoconductive drum 9 and the developing device 11 are configured to be attached to and detached from each image forming part 8 from the upper side of the printer main body 2. That is, the attachment and detachment direction of the photosensitive drum 9 and the developing device 11 is orthogonal to the rotating shafts of the photosensitive drum 9 and the developing device 11. The rotating shafts of the photosensitive drum. 9 and the developing device 11 are rotated by a driving unit 17. The driving unit 17 is arranged a position corresponding to each image forming part 8.

Above the intermediate transferring unit 5, a toner container 15 corresponding to each image forming part 8 is arranged in the left and right directions for each toner color. A space above the toner containers 15 is opened and closed with a top cover 18 (opening/closing member). Aright side portion of an upper face of the top cover 18 is employed as the ejected sheet tray 4. The top cover 18 is openably/closely supported to the printer main body 2 around the right end. With the top cover 18 opened (shown in FIG. 2), the toner containers 15 and the intermediate transferring unit 5 and the others can be detached. Furthermore, after detaching the intermediate transferring unit 5, the photosensitive drum 9 and the developing device 11 can be detached.

At a left back corner of an inner face of the top cover, a pressing part 18*a* protruding downward is formed. On the contrary, at a left back corner of the inside of the printer main body 2, an aperture 2*a* (shown in FIG. 2) is formed. Through the aperture 2*a*, the pressing part 18*a* is penetrated when the top cover 18 is closed. Below the aperture 2*a*, a push switch type switching member 19 is arranged. The switching member 19 detects that the top cover 18 is closed and makes the color printer 1 into an operation possible state.

Under each image forming parts 8, an exposure device 20 composed of a laser scanning unit (LSU) is installed.

On a right side part of the inside of the printer main body 2, a conveying path 21 of the sheet is formed extending in the upward and downward directions from the sheet feeding cartridge 3 to the ejected sheet tray 4. At an upstream end of the conveying path 21, a sheet feeder 22 is positioned. At an intermediate stream portion of the conveying path 21, a second transferring part 23 is positioned at one end (a right end of the figure) of the intermediate transferring belt 6. At a downstream portion of the conveying path 21, a fixing device 24 is positioned. At a downstream end of the conveying path 21, an ejection port 25 is positioned.

Next, the operation of forming an image by the color printer 1 having such a configuration will be described. When the power is supplied to the color printer 1, various parameters are initialized in a control circuit and initial determination, such as temperature determination of the fixing device 24, is carried out. Subsequently, image data is input from a computer connected to the color printer 1 and then a stating of printing is instructed, image forming operation is carried out as follows.

First, the surface of the photosensitive drum 9 is electric-charged by the charger 10. Then, on the surface of the photosensitive drum 9, an electrostatic latent image is formed by a laser light (refer to an arrow P in FIG. 1) from the exposure device 20. The electrostatic latent image is developed to a toner image having a correspondent color with the toner supplied from the toner container 15 in the development device 11. The toner image is first-transferred onto the surface of the intermediate transferring belt 6 in the first transferring part 12. The above-mentioned operation is repeated in order by the respective image forming parts 8, thereby forming the toner image having full color onto the intermediate transferring belt 6. Toner and electric charge remained on the photosensitive drum 9 are eliminated by the cleaning device 13 and static eliminator 14.

On the other hand, the sheet fed from the sheet feeding cartridge 3 by the sheet feeder 22 is conveyed to the second transferring part 23 in a suitable timing for the above-mentioned image forming operation. Then, in the second transferring part 23, the toner image having full color on the intermediate transferring belt 6 is second-transferred onto the sheet. The sheet with the second-transferred toner image is conveyed to a downstream side on the conveying path 21 to enter the fixing device 24, and then, the toner image is fixed on the sheet in the fixing device 24. The sheet with the fixed toner image is ejected from the ejection port 25 onto the ejected sheet tray 4.

Figure 3:
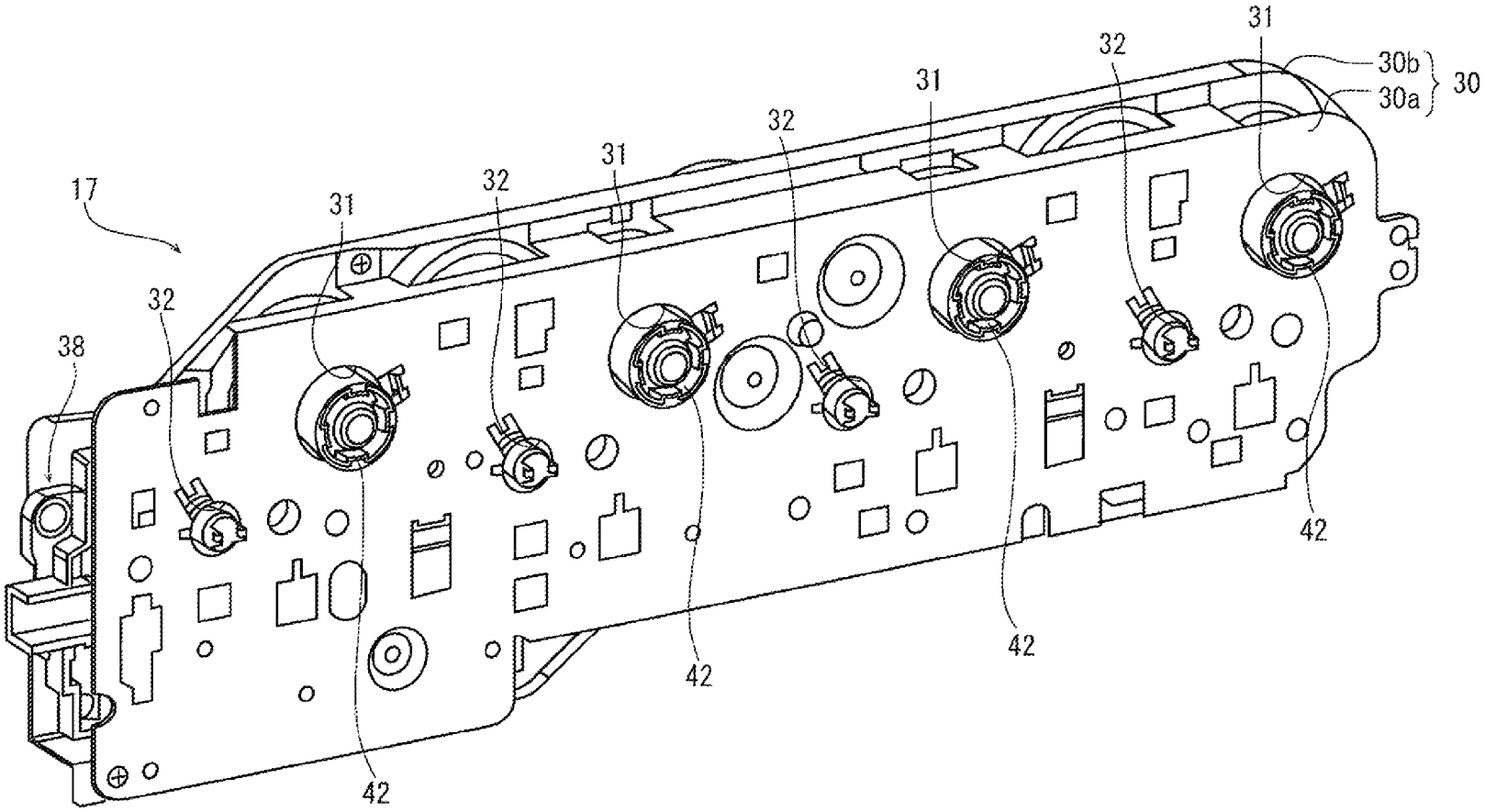
FIG. 3 is a perspective view showing a driving unit under a rotation force transmission state, in the color printer according to the embodiment of the present disclosure.

Next, the driving unit 17 will be described referring to FIG. 3 to FIG. 6. FIG. 3 is a perspective view showing the driving unit at the rotation force transmission time, FIG. 4 is a perspective view showing the driving unit at the rotation force transmission release time, FIG. 5 is a front view showing an inside of the driving unit at the rotation force transmission time, and FIG. 6 is a front view showing the inside of the driving unit at the rotation force transmission release time.

Figure 4:
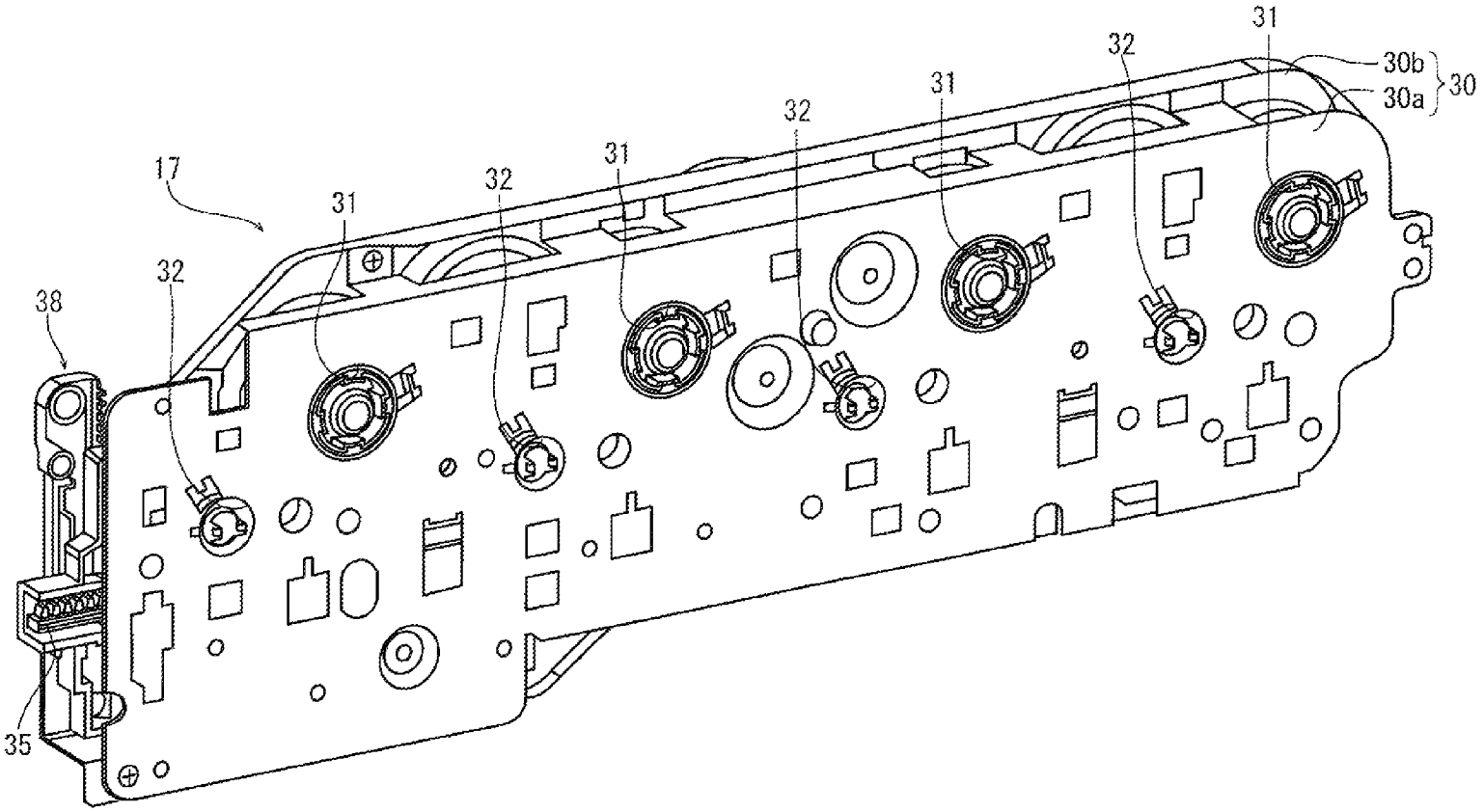
FIG. 4 is a perspective view showing the driving unit under a rotation force transmission release state, in the color printer according to the embodiment of the present disclosure.

The driving unit 17, as shown in FIG. 3 and FIG. 4, has a transversely elongated, rectangular solid-shaped housing 30 formed flat in the forward and backward directions. The housing 30 has an inner plate 30*a* and an outer plate 30*b* each formed in a transversely elongated substantially rectangular shape. The inner plate 30*a* has circular apertures 31, 32 each formed at a position corresponding to each rotating shaft of the photosensitive drum 9 and the development device 11 of each image forming part 8.

Figure 5:
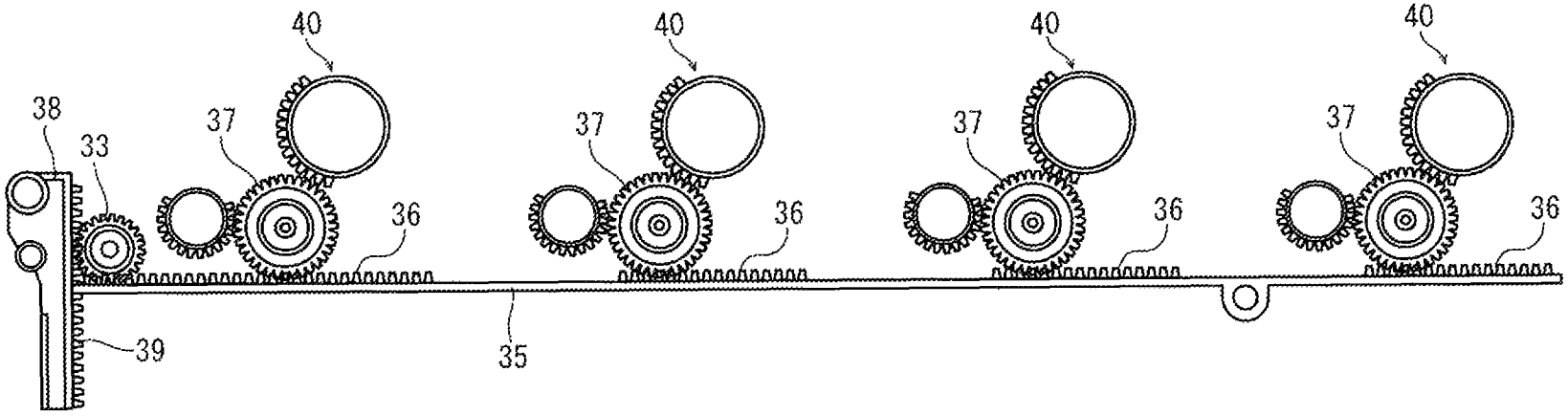
FIG. 5 is a front view showing inside of the driving unit under the rotation force transmission state, in the color printer according to the embodiment of the present disclosure.
Figure 6:
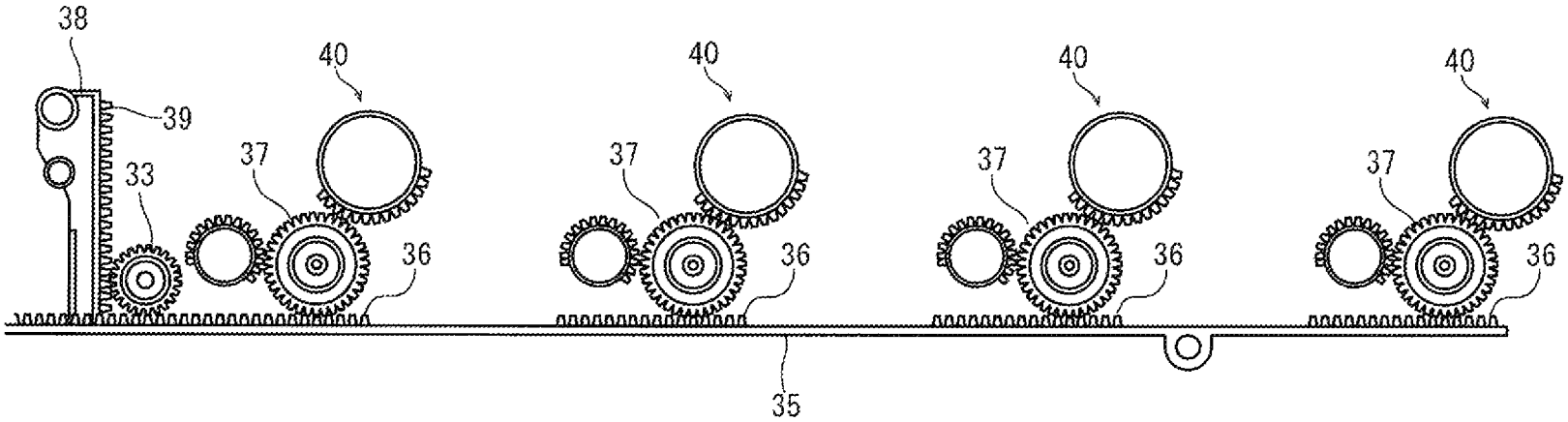
FIG. 6 is a front view showing inside of the driving unit under the rotation force transmission release state, in the color printer according to the embodiment of the present disclosure.

Inside the housing 30, as shown in FIG. 5 and FIG. 6, a movable bar 35 extending in the left and right directions is supported reciprocally in the left and right directions. The movable bar 35 has a rack gear 36 at a position corresponding to each image forming part 8. At a left end of the inside of the housing 30, a pinion gear 33 engaging with the rack gear 36 formed at a leftmost end of the movable bar 35; and a rack member 38 formed with a rack gear 39 engaging with the pinion gear 33 are arranged. The rack member 38 is a longitudinally elongated plate-shaped member, and is supported reciprocally in the upward and downward directions. The movement of the rack member 38 in the upward and downward directions moves the movable bar 35 in the left and right directions via the pinion gear 33. Inside the housing 30, a gear train or the like provided so as to engage with a rotating shaft of a driving source (not shown) such as a motor is disposed.

Inside the housing 30, at a position corresponding to each image forming part 8, an idle gear 37 engaging with the rack gear 36 of the movable bar 35 is rotatably supported. Further, at a position corresponding to each rotating shaft of the development device 11 and the photosensitive drum 9 of each image forming part 8, a rotation force transmission mechanism 40 which transmits a rotation force generated at the driving source to the rotating shaft of the photosensitive drum 9 and a rotation force transmission mechanism (not shown) which transmits the rotation force generated at the driving source to the rotating shaft of the development device 11 each are disposed at a position corresponding to a respective one of apertures 31, 32 of the inner plate 30.

Figure 7:
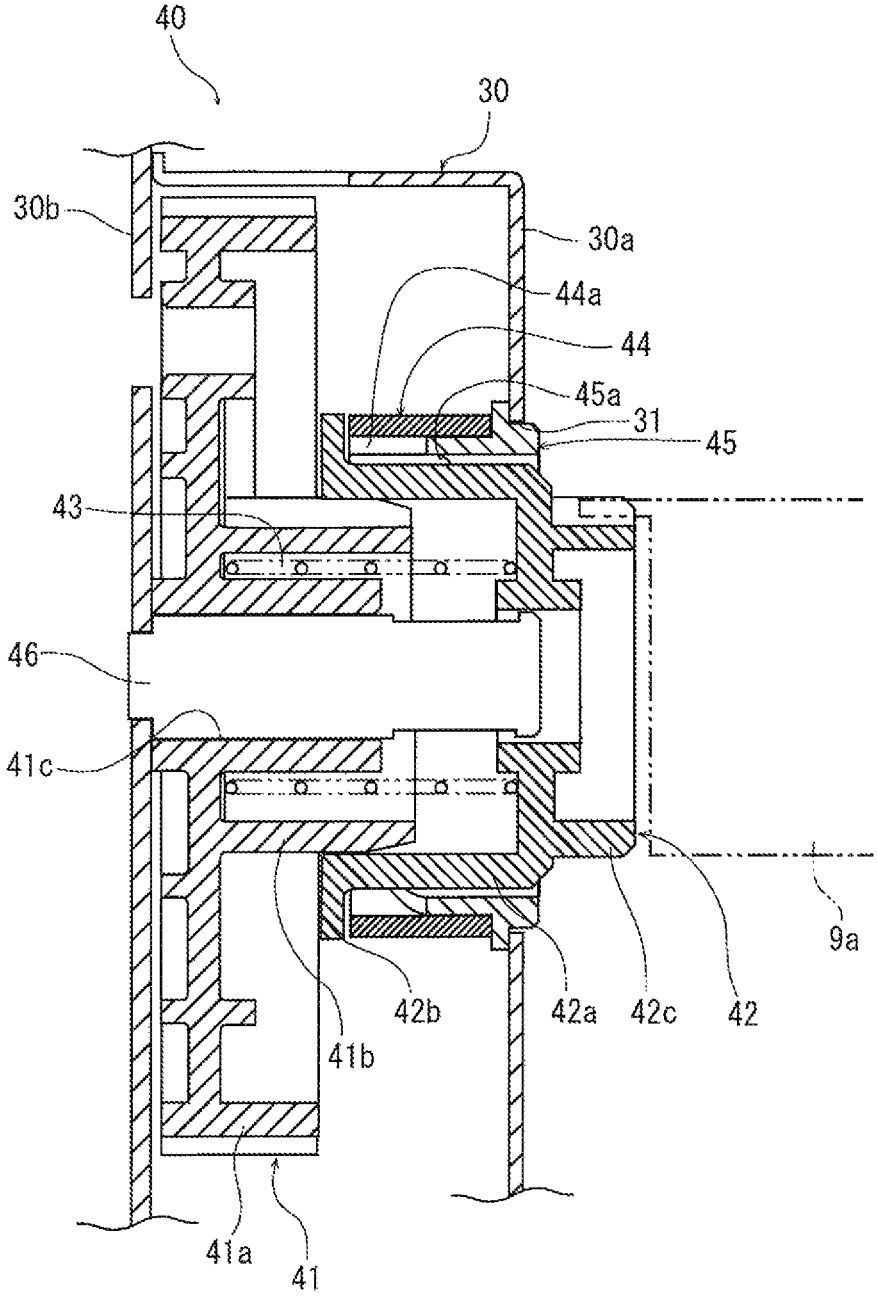
FIG. 7 is a side view showing of a rotation force transmission mechanism of the driving unit under the rotation force transmission state, in the color printer according to the color printer in the embodiment of the present disclosure.
Figure 8:
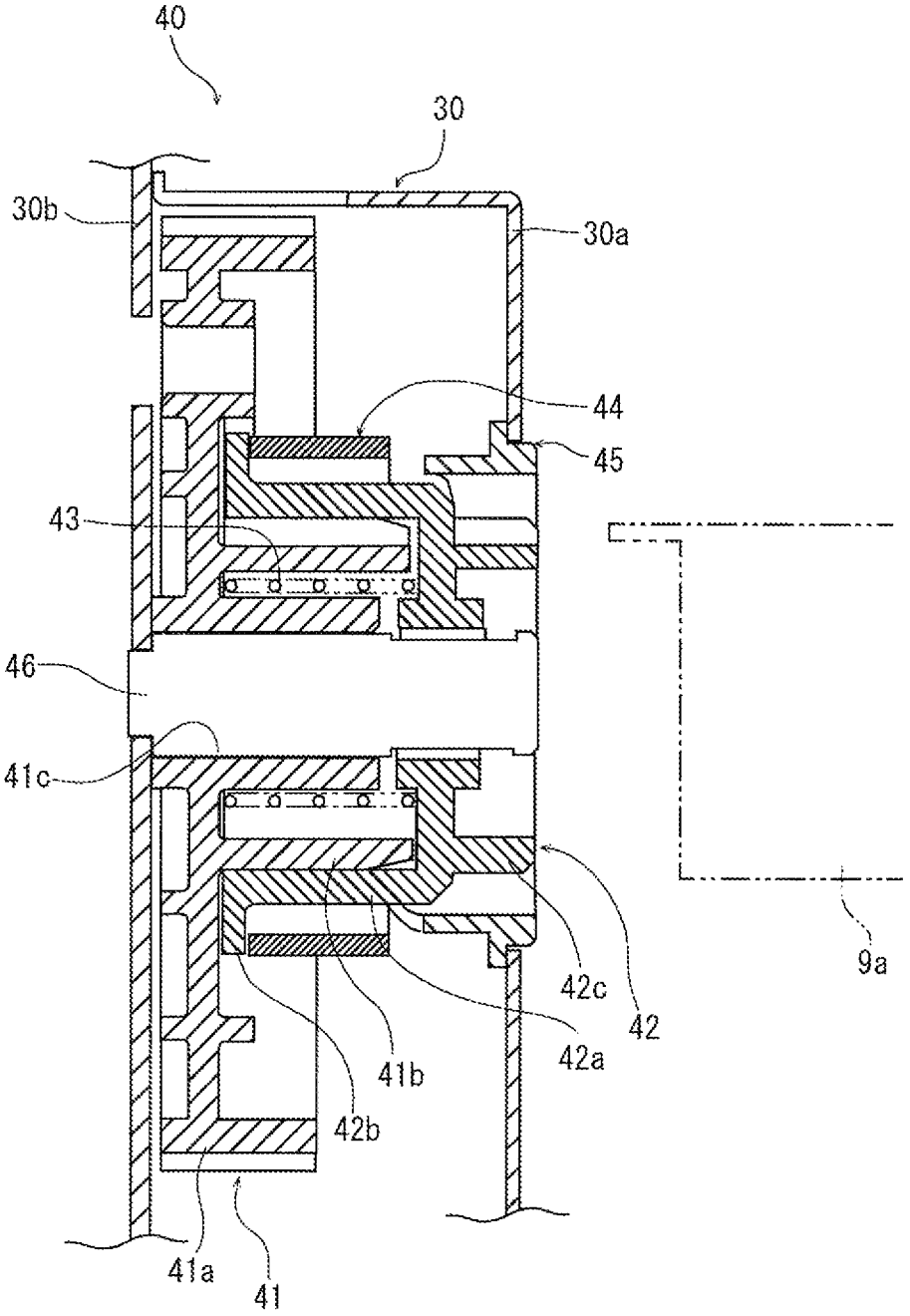
FIG. 8 is a side view showing the rotation force transmission mechanism of the driving unit under the rotation force transmission release state, in the color printer according the embodiment of the present disclosure.
Figure 9:
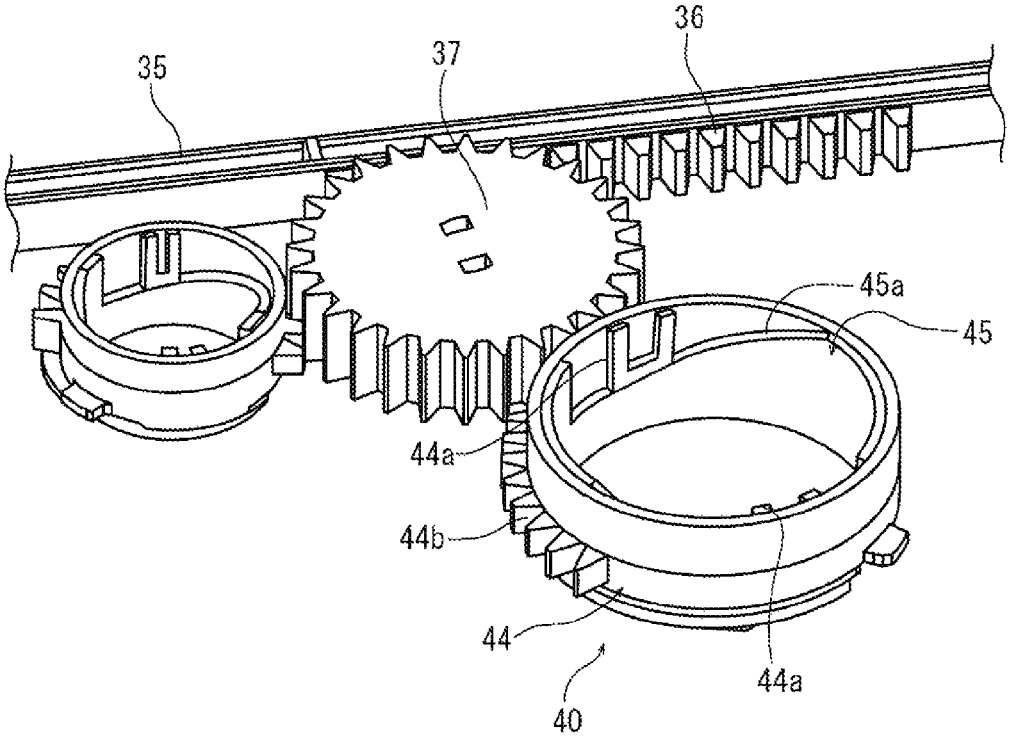
FIG. 9 is a perspective view showing a cam member and a bush under the rotation force transmission state under the rotation force transmission state, in the color printer according to the embodiment of the present disclosure.
Figure 10:
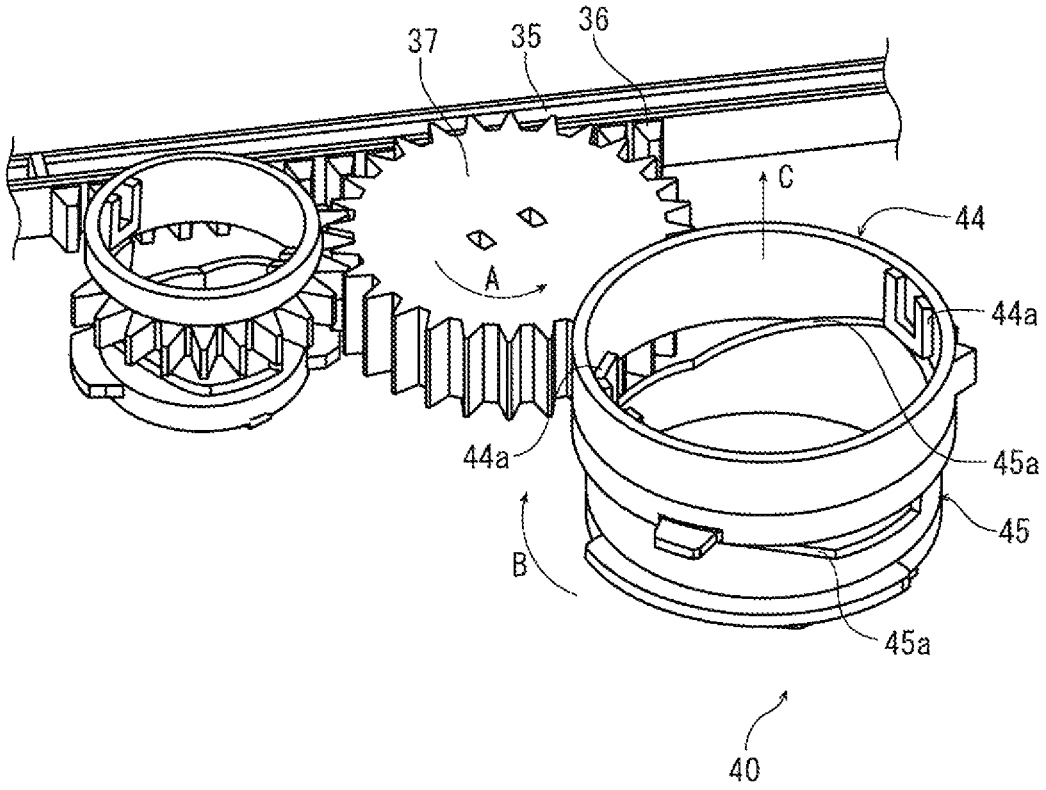
FIG. 10 is a perspective view showing the cam member and the bush under the rotation force transmission release state, in the color printer according to the embodiment of the present disclosure.

Next, the rotation force transmission mechanism 40 of the photosensitive drum 9 will be described referring to FIG. 7 to FIG. 10. FIG. 7 is a side view showing the rotation force transmission state, FIG. 8 is a side view showing the rotation force transmission release state, FIG. 9 is a perspective view showing a cam member and a bush in the rotation force transmission state, and FIG. 10 is a perspective view showing the cam member and the bush in the rotation force transmission release state. In FIG. 9 and FIG. 10, a downward direction indicates the front side of the printer main body, and an upward direction indicates the back side. Also, in FIG. 9 and FIG. 10, only the cam member and the bush of the rotation force transmission mechanism are shown.

As shown in FIG. 7, the rotation force transmission mechanism 40 has: a driving gear 41 (driving shaft) rotated by the driving source; a joint member 42 capable of coupling to a joint part provided at the rotating shaft 9*a* (driving shaft) of the photosensitive drum 9; a coil spring 43 biasing the joint member 42 toward the joint part of the photosensitive drum 9; a cam member 44 pressing the joint member 42 in an axial direction of the rotating shaft of the driving unit 17; and a bush 45 with which the cam member 44 comes in contact.

The driving gear 41 has a disk-shaped gear part 41*a* and a shaft part 41*b* protruding forward from a center of the gear part 41*a*, and a through hole 41*c* is formed on a center axis.

The joint member 42 is a cylindrical member to be fitted onto the shaft part 41*b* of the driving gear 41, and has: a cylindrical part 42*a*; and a circular ring-shaped flange part 42*b* overhanging outward from a back end face of the cylindrical part 42*a*. At a tip end face of the cylindrical part 42*a*, an engaging part 42*c* protruding forward is formed. The engaging part 42*c* is configured to engage with the joint part of the photosensitive drum 9. The joint member 42 is fitted onto the shaft part 41*b* of the driving gear 41 so as to integrally rotate with the driving gear 41 and to move in the forward and backward directions along the shaft part 41*b*.

The coil spring 43 is interposed between the shaft part 41*b* of the driving gear 41 and the tip end face of the cylindrical part 42*a* of the joint member 42, and biases the joint member 42 forward with respect to the driving gear 41.

The cam member 44 is a cylindrical member to be loosely fitted onto the cylindrical part 42*a* of the joint member 42, and is formed so that a back end face comes into contact with a front face of the flange part 42*b* of the joint member 42. On diagonal lines of an inner circumferential face of the cam member 44, as shown in FIG. 9 and FIG. 10, cams 44*a* are formed. Also, along substantially ⅓ of an outer circumferential face of the cam member 44, a gear 44*b* is formed. This gear 44*b* is configured to engage with the idle gear 37.

The bush 45 is a cylindrical member to be fitted into the cam member 44. On a back end face of the bush 45, an inclined end face 45*a* with which each cam 44*a* of the cam member 44 comes in contact is circumferentially formed so as to incline forward from a back end of the bush 45.

The rotation force transmission mechanism 40 is disposed between the inner plate 30*a* and the outer plate 30*b* in the aperture 31 formed in the inner plate 30*a* of the housing 30.

On an inner face of the outer plate 30*b* of the housing 30, a bearing 46 is erected. The bearing 46 is inserted in the through hole 41*c* of the driving gear 41. The gear part 41*a* of the driving gear 41 engages with the rotating shaft of the driving source 49 such as a motor via a decelerator or a gear train (not shown), and if the driving source is driven, the driving gear 41 is rotatable around the bearing 46. Onto the shaft part 41*b* of the driving gear 41, the joint member 42 is fitted via the coil spring 43.

Into the cam member 44, the bush 45 is fitted, and the cams 44*a* of the cam member 44 engages with the inclined end faces 45*a* of the bush 45. The bush 45 is loosely fitted onto the cylindrical part 42*a* of the joint member 42 while being fitted into the cam member 44, and is positioned in the aperture 31 of the inner plate 30*a* of the housing 30.

The joint member 42 is biased by the coil spring 43, the engaging part 42*c* protrudes forward from the aperture 31 of the inner plate 30*a*, and the front face of the flange part 42*b* comes in contact with the back end face of the cam member 44.

Next, a rotation force transmission operation and a rotation force transmission release operation by the rotation force transmission mechanism 40 will be described. In the rotation force transmission state shown in FIG. 6 and FIG. 8, the cams 44*a* of the cam member 44 come in contact with portions close to the deepest portions of the inclined end faces 45*a* of the bush 45. That is, the cam member 44 is positioned at a most forward portion along an outer face of the bush 45. Then, the joint member 42 is biased forward by the coil spring 43 until the front face of the flange part 42*b* comes in contact with the back end face of the cam member 44, and advances up to a position at which the engaging part 42*c* can engage with the joint part formed at the rotating shaft 9*a* of the photosensitive drum 9. That is, the joint part protrudes forward from the inner plate 30*a* of the housing 30 (refer to FIG. 2 as well). When the joint part 9*a* of the rotating shaft of the photosensitive drum 9 and the joint member 42 engage with each other and then the driving gear 41 is rotated, the joint member 42 integrally rotates with the driving gear 41 and then the rotating shaft of the photosensitive drum 9 engaging with the joint member 42 rotates.

When the rotation force transmission is released, the rack member 38 (refer to FIG. 4 and FIG. 5) of the housing 30 is pulled up to move the movable bar 35 leftward and then to rotate the idle gear 37. As shown in FIG. 9, the rotation of the idle gear 37 (refer to the arrow A of FIG. 10) rotates the cam member 44 engaging with the idle gear 37 (refer to the arrow B of FIG. 10) while the inner circumferential face of the cam member 44 comes into sliding contact with an outer circumferential face of the bush 45 and the cams 44*a* of the cam member 44 move in a direction in which a depth of the inclined end faces 45*a* of the bush 45 becomes shallow. Namely, the cam member 44 moves backward (refer to the arrow C of FIG. 10), and the flange part 42*b* of the joint member 42 is pressed backward by the back end face of the cam member 44. In this manner, the joint member 42 retracts in an axial direction. The joint member 42, as shown in FIG. 8, retracts until the flange part 42*b* comes in contact with the front face of the gear part 41*a* of the driving gear 41. In this state, the engaging part 42*c* of the joint member 42 is completely spaced away from the joint part of the rotating shaft 9*a* of the photosensitive drum 9, and the rotation force transmission of the driving source is released. Also, the joint member 42 retracts until substantially identical to the outer face of the inner plate 30*a* of the housing 30.

In such the driving unit 17, when the rotation force transmission mechanism 40 is set in the rotation force transmission state, as shown in FIG. 7 or the like, the joint member 42 protrudes forward from the inner plate 30*a* of the housing 30. Thus, in the rotation force transmission state, if the photosensitive drum 9 is incorrectly detached or if the detached photosensitive drum 9 is incorrectly attached, the joint part of the photosensitive drum 9 comes into contact with the joint member 42, and the joint part of the photosensitive drum 9 or the joint member 42 of the rotation force transmission mechanism 40 may be damaged.

Thus, the color printer 1 is provided with an incorrect attachment and detachment preventing mechanism 50 which prevents attachment and detachment of the photosensitive drum 9 when the rotation force transmission mechanism 40 is set in the rotation force transmission state.

Figure 11:
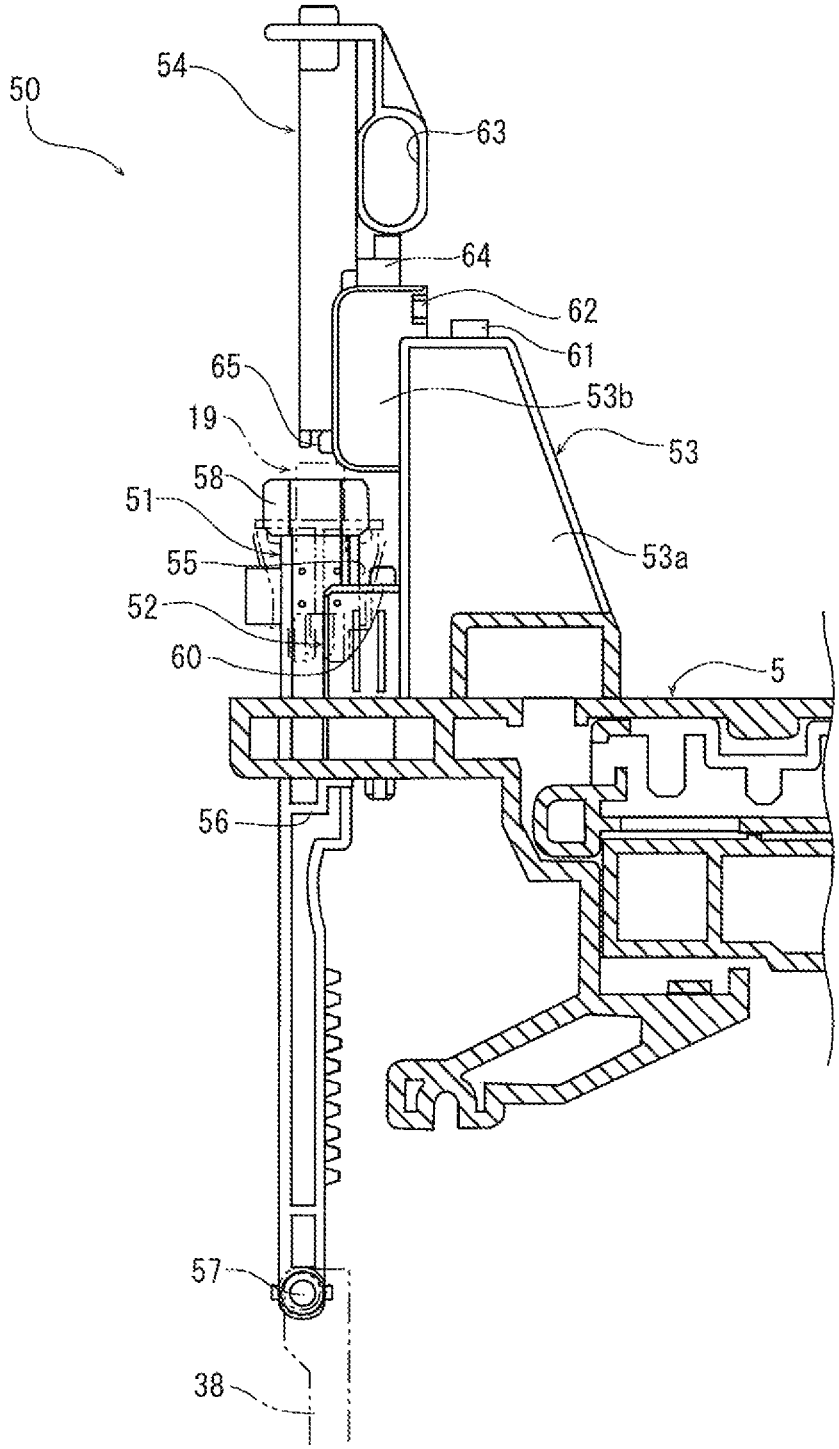
FIG. 11 is a front view of an incorrect attachment or detachment preventing mechanism of the color printer according to the embodiment of the present disclosure.
Figure 14:
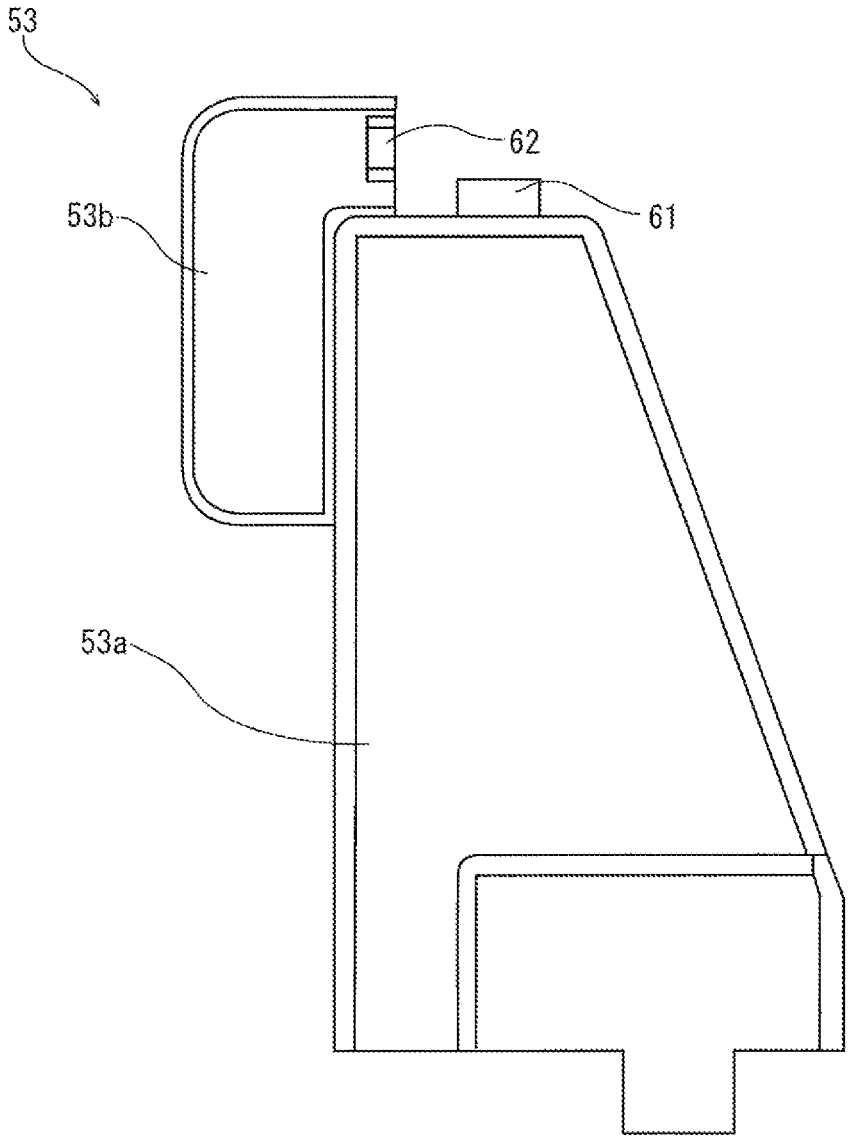
FIG. 14 is a front view of a wire cover of the incorrect attachment or detachment preventing mechanism of the color printer according the embodiment of the present disclosure.
Figure 15:
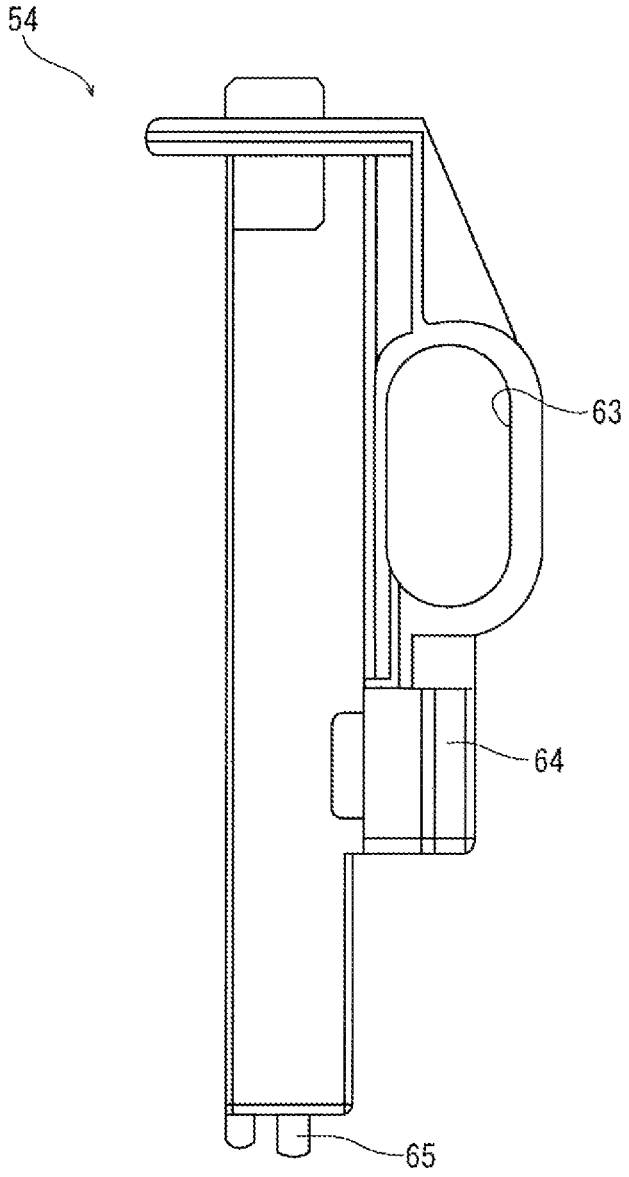
FIG. 15 is a front view of a pressing member of the incorrect attachment or detachment preventing mechanism of the color printer according to the embodiment of the present disclosure.

Next, the incorrect attachment and detachment preventing mechanism 50 will be described referring to FIG. 11 to FIG. 15. FIG. 11 is a front view of the incorrect attachment and detachment preventing mechanism, FIG. 12 is a front view of a manual lever, FIG. 13 is a front view of a locking member, FIG. 14 is a front view of a wire cover, and FIG. 15 is a front view of a pressing member.

The incorrect attachment and detachment preventing mechanism 50 is disposed at the back left corner of the printer main body 2, and, as shown in FIG. 11, this mechanism includes: a manual lever 51 to be coupled to the rack member 38 of the driving unit 17; a locking member 52 engaging with the intermediate transferring unit 5 and the manual lever 51; a wire cover 53 which covers wires such as a signal line or a power line connected to the intermediate transferring unit 5 and the driving unit 17; and a pressing member 54 which presses the switching member 19.

Figure 12:
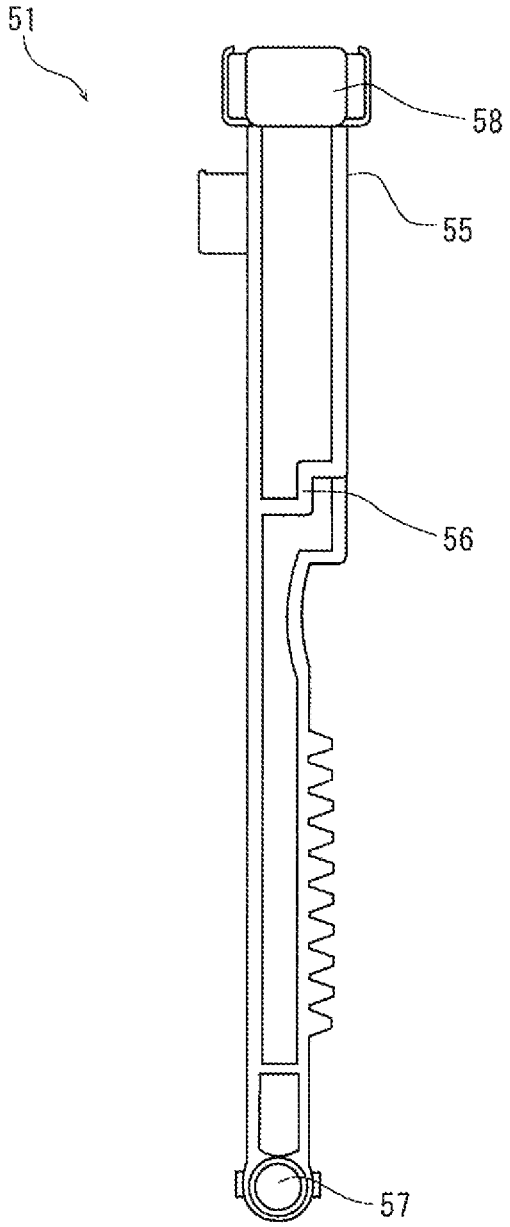
FIG. 12 is a front view of a manual lever of the incorrect attachment or detachment preventing mechanism of the color printer according to the embodiment of the present disclosure.

The manual lever 51, as shown in FIG. 12, is a longitudinally elongated plate-shaped member. Near an upper end of a right side face of the manual lever 51, an engaging face 55 (first engaging part) engaging with the locking member 52 is formed, and near a center of a front face, a substantially Z-shaped rib 56 (second engaging part) is formed. At a lower end of the manual lever 51, a boss 57 protruding forward is formed. The boss 57 is engaged with an aperture formed at an upper end of the rack member 38 of the rotation force transmission mechanism 40 so that the manual lever 51 and the rack member 38 are coupled to each other in the upward and downward direction. At an upper end of the manual lever 51, a flat rectangular solid-shaped head part 58 extending in the forward and backward directions is formed.

Figure 13:
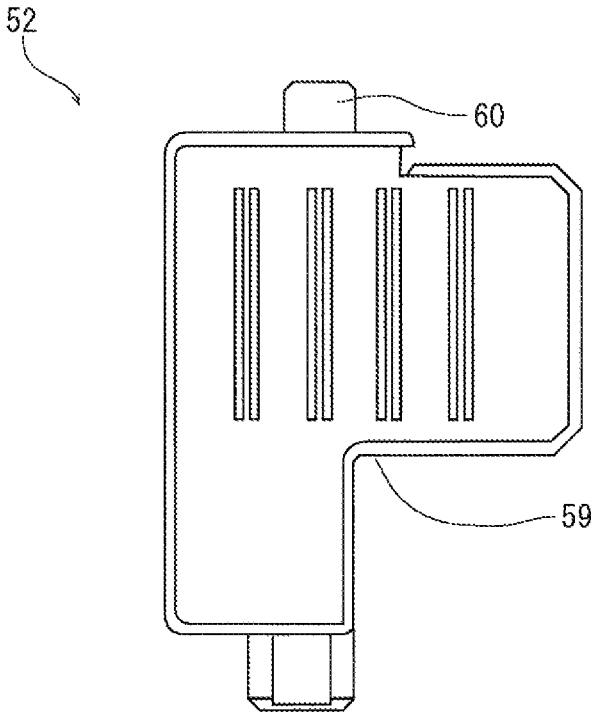
FIG. 13 is a front view of a locking member of the incorrect attachment or detachment preventing mechanism of the color printer according to the embodiment of the present disclosure.

The locking member 52, as shown in FIG. 13, is a rectangular solid-shaped member, and a notch 59 is formed at a right lower corner. The notch 59 is formed so as to be engaged with the intermediate transferring unit 5. Near a center of a top face of the locking member 52, an engaging protrusion 60 protruding backward is formed. This engaging protrusion 60 is configured to engage with the engaging face 55 or the rib 56 of the manual lever 51.

Figure 16:
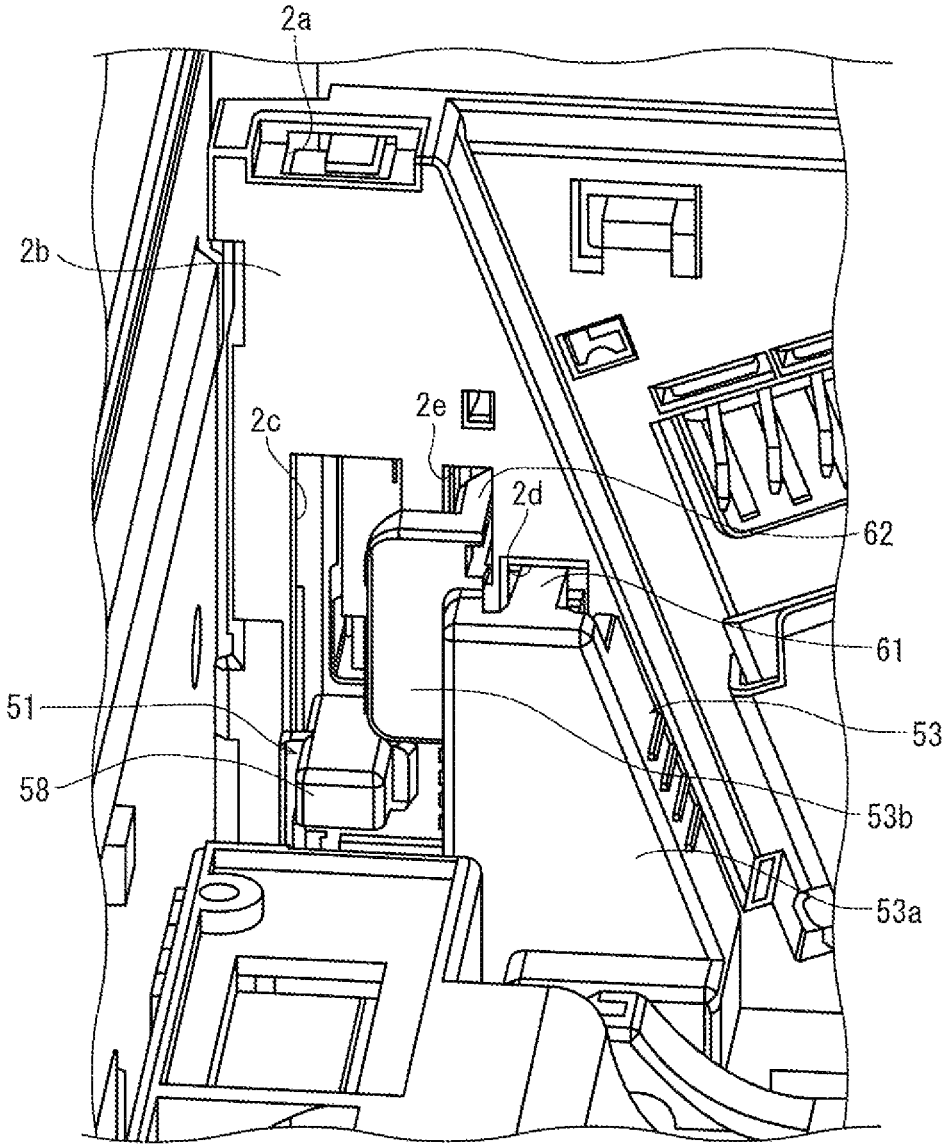
FIG. 16 is a perspective view showing the wire cover and the manual lever of the incorrect attachment or detachment preventing mechanism of the color printer according to the embodiment of the present disclosure.

The wire cover 53, as shown in FIG. 14, is a member having: a main body part 53*a* with a trapezoidal front shape; and an upper part 53*b* with a substantially rectangular front shape formed at an upper left corner of the main body part 53*a*, a lower face and a back face of which are open. As shown in FIG. 16, the back face of the wire cover 53 is opposed to the back side plate 2*b* of the printer main body 2, whereby a space is formed between the back side plate 2*b* and the wire cover 53 so as to house the wires or the like therein. On a top face of the main body part 53*a*, an engaging part 61 protruding backward is formed. On a right side face of the upper part 53*b*, a claw part 62 protruding backward is formed. The claw part 62, as shown in FIG. 16 also, has a front shape of a U-shape of which a right side opens, and a back end face is inclined in the forward and backward directions.

The pressing member 54, as shown in FIG. 15, is a longitudinally elongated rectangular solid-shaped member. On a right side face of the pressing member 54, an elongated hole 63 extending in the upward and downward directions is formed. Below the elongated hole 63, a protrusion part 64 protruding rightward is formed. The protrusion part 64 is a square in front shape, and has a front end face inclined in the forward and backward directions and a right side face formed into a vertical face. On a lower end face of the pressing member 54, a protrusion part 65 protruding downward is formed.

Figure 17A:
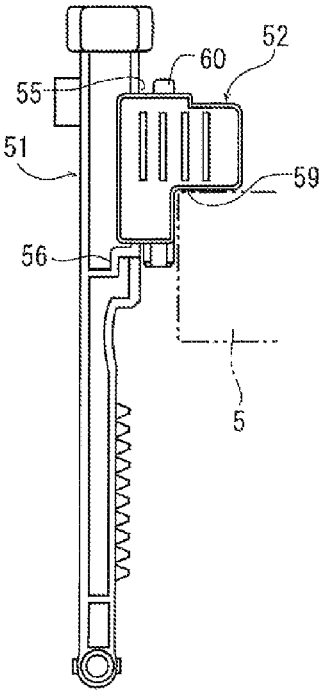
Figure 17B:
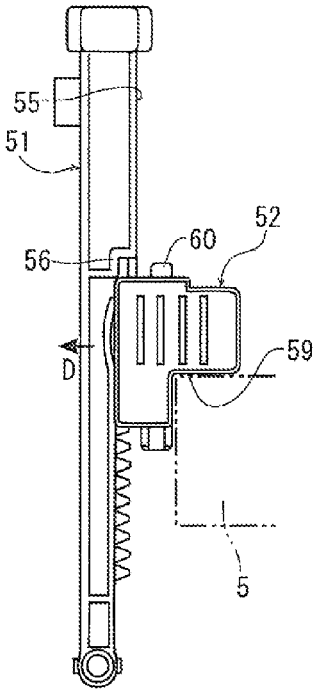
Figure 18A:
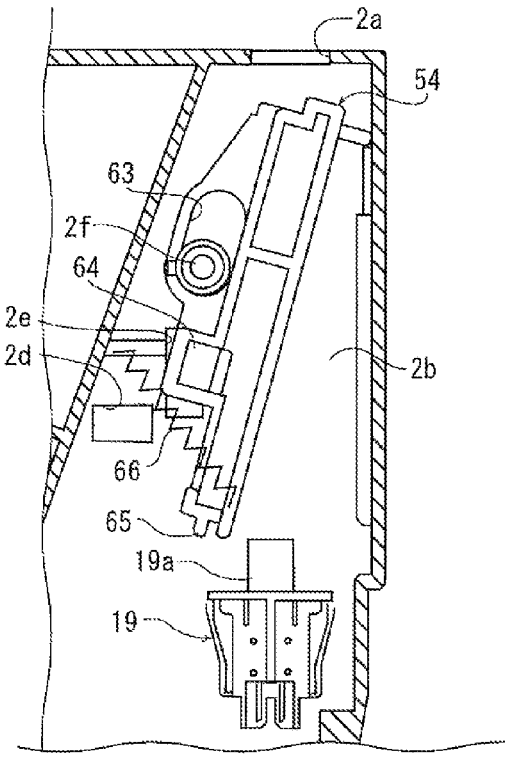
FIG. 18A and FIG. 18B are back views each showing a position of the pressing member of the incorrect attachment or detachment preventing mechanism of the color printer according to an embodiment of the present disclosure.
Figure 18B:
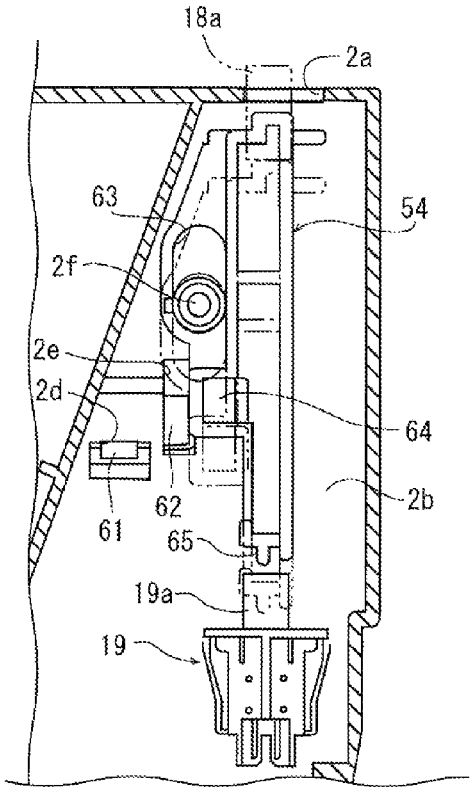

The incorrect attachment and detachment preventing mechanism 50 having the construction mentioned above, as shown in FIG. 16, FIG. 17A, FIG. 17B, FIG. 18A, and FIG. 18B, is disposed on the back side plate 2*b* below the aperture 2*a* of the printer main body 2. FIG. 16 is a perspective view showing positions of the wire cover and the manual lever. FIG. 17A and FIG. 17B are front views each showing a positional relationship between the manual lever and the locking member, and FIG. 18A and FIG. 18B are back views each showing a position of the pressing member.

The manual lever 51 is coupled to the rack member 38 of the rotation force transmission mechanism 40, and as shown in FIG. 16, the head part 58 engages with an elongate hole 2*c* extending in the upward and downward directions, formed on the back side plate 2*b*. In this manner, the manual lever 51 is movably supported in the upward and downward directions along the elongated hole 2*c*. In the rotating force transmission state, the manual lever 51 is pressed down until the head part 58 reaches a lowest portion of the elongated hole 2*c*.

The wire cover 53, at an upper right of the head part 58 of the manual lever 51, is attached in such a way that the engaging part 61 and the claw part 62 are respectively inserted into a transverse aperture 2*d* and a longitudinal aperture 2*e* which are formed on the back side plate 2*b*, and protects the wires or the like. When the wire cover 53 is attached, a left end portion of the upper part 53*b* of the wire cover 53 overlaps with a right end portion of the elongated hole 2*c*, and a lower face of the upper part 53*b* opposes to a top face of the head part 58 of the manual lever 51 via a slight gap. That is, when the wire cover 53 is attached, the manual lever 51 cannot be moved upward.

As shown in FIG. 17A, the locking member 52 is attached into a position (restrict position) where a left side face of the engaging protrusion 60 opposes to the engaging face 55 of the manual lever 51 via a slight gap below the head part 58 of the manual lever 51 and the notch 59 is engaged with the intermediate transferring unit 5. In this state, if the locking member 52 is tried to be moved leftward, since the left side face of the engaging protrusion 60 comes in contact with the engaging face 55 of the manual lever 51, the locking member 52 is restricted from being moved. That is, the engagement of the locking member 52 with the intermediate transferring unit 5 cannot be released.

Figure 17C:
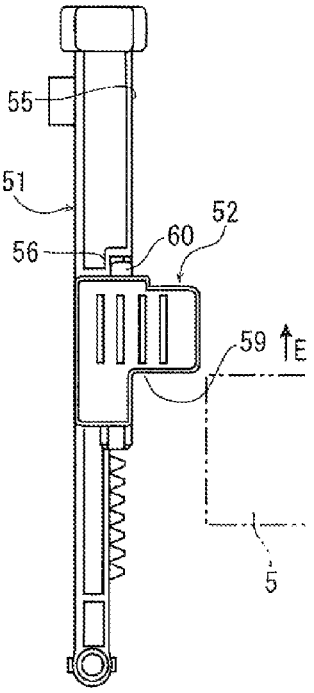

On the other hand, as shown in FIG. 17B, if the manual lever 51 is pulled up, the locking member 52 can be moved in a leftward direction up to a position (permission position) where the engaging protrusion 60 comes in contact with a right side face of the rib 56 of the manual lever 51 (refer to the arrow D of FIG. 17B), and by moving the locking member 52 leftward, since the intermediate transferring unit 5 releases from the notch 59, the intermediate transferring unit 5 can be detached as indicated by the arrow E of FIG. 17C. That is, the photosensitive drum 9 can be detached.

The pressing member 54, as shown in FIG. 18A, is disposed between the aperture 2*a* and the switching member 19 on the back face of the back side plate 2*b* of the printer main body 2. On the back face of the back side plate 2*b*, a protrusion 2*f* protruding backward is formed. This protrusion 2*f* engages with the elongated hole 63 of the pressing member 54. Between a lower portion of the pressing member 54 and the back side plate 2*b*, a spring 66 is interposed, and biases the lower portion of the pressing member 54 in an upper leftward direction. The spring 66 displaces the pressing member 54 into an inclined posture in an oblique leftward direction and pulls it up until the protrusion 2*f* is engagingly stopped with the lowest portion of the elongated hole 63. Specifically, an upper end face of the pressing member 54 is spaced away from the aperture 2*a* leftward and the protrusion part 65 is spaced away from the switching part 19*a* of the switching member 19 rightward. That is, the pressing member 54 is displaced in a posture incapable of pressing the switching member 19. At this posture, the protrusion part 64 of the pressing member 54 faces the longitudinal aperture 2*e* of the back side plate 2*b*.

When the wire cover 53 is attached, as shown in FIG. 18B, the engaging part 61 of the wire cover 53 is inserted into the transverse aperture 2*d* of the back side plate 2*b* and the claw part 62 is inserted into the longitudinal aperture 2*e*. Then, the inclined back end face of the claw part 62 comes in contact with the inclined front end face of the protrusion part 64 of the pressing member 54 and then presses it backward. If the claw part 62 is further inserted, a left side face of the claw part 62 comes in contact with the right side face of the protrusion part 64 and then the pressing member 54 is displaced into a vertical posture from the inclined posture against a biasing force of the spring 66. Specifically, the upper end face of the pressing member 54 is positioned below the aperture 2*a* and the protrusion part 65 opposes to the switching part 19*a* of the switching member 19. That is, the pressing member 54 is displaced in a posture capable of pressing the switching member 19. In FIG. 18B, the spring 66 is not shown.

When the top cover 18 of the printer main body 2 is closed under a state in which the pressing member 54 is set in the posture capable of pressing the switching member 19, the upper end face of the pressing member 54 is pressed by the protrusion part 18*a* of the top cover 18, the pressing member 54 slides downward along the elongated hole 63, the switching part 19*a* of the switching member 19 is pressed by the protrusion part 65, and the switching member 19 detects that the top cover 18 is closed.

Figure 19:
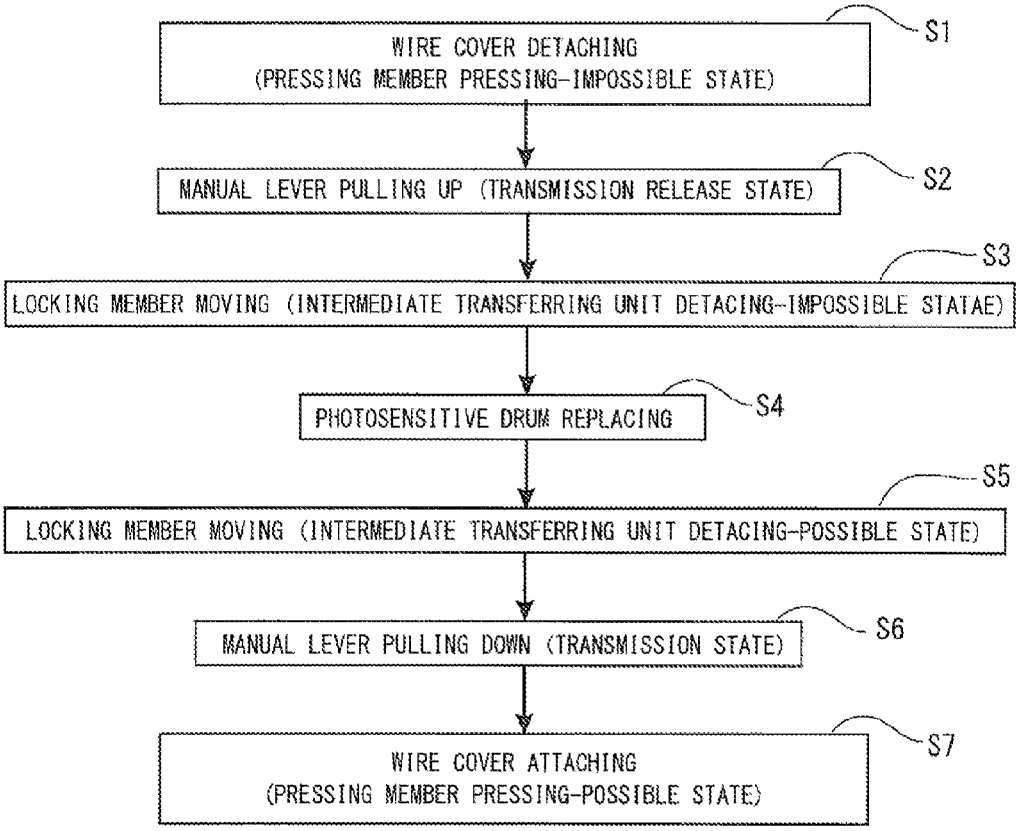
FIG. 19 is a flowchart showing a replacement work of the image forming unit of the color printer according to an embodiment of the present disclosure.

Next, a replacement work of the photosensitive drum 9 will be described referring to FIG. 19, FIG. 16, FIG. 17A, FIG. 17B, FIG. 18A, and FIG. 18B. FIG. 19 is a flowchart showing the replacement work of the photosensitive drum.

First, the wire cover 53 is detached (S1). Then, as shown in FIG. 18A, the pressing member 54 is displaced by the spring 66 into the posture incapable of pressing the switching member 19. Even if the top cover 18 is closed in this state, the switching member 19 cannot be pressed by the pressing member 54.

Also, if the wire cover 53 is detached, as shown in FIG. 16, the manual lever 51 can be pulled up, and then the manual lever 51 is pulled up (S2). In this manner, the rack member 38 is pulled up, and the rotation force transmission mechanism 40 switches into the rotation force transmission release state. Furthermore, as shown in FIG. 17B, when the manual lever 51 is pulled up, the engagement of the locking member 52 with the engaging face 55 of the manual lever 51 is released and the locking member 52 can be moved. Then, as shown in FIG. 17C, the locking member 52 is moved leftward to release the engagement of the intermediate transferring unit 5 with the notch 59 and to engage the engaging protrusion 60 with the rib 56 of the manual lever 51. In this manner, the intermediate transferring unit 5 can be detached (S3).

Then, the intermediate transferring unit 5 is detached, the photosensitive drum 9 is replaced (S4) and then the intermediate transferring unit 5 is attached again. In this state, as shown in FIG. 17C, since the engaging protrusion 60 of the locking member 52 also engages with the lower face of the rib 56 of the manual lever 51, the manual lever 51 is in a state incapable of being pressed, that is, in a state incapable of switching the rotation force transmission mechanism 40 into the transmission state.

Thus, as shown in FIG. 17B, the locking member 52 is moved rightward to engage the notch 59 with the intermediate transferring unit 5. In this manner, the intermediate transferring unit 5 cannot be detached (S5). Furthermore, the engagement of the engaging protrusion 60 of the locking member 52 with the rib 56 of the manual lever 51 are released and therefore the manual lever 51 can be pulled down.

Then, the manual lever 51 is pulled down (S6). In this manner, the rotation force transmission mechanism 40 switches into the transmission state. Then, the wire cover 53 is attached (S7). Then, as shown in FIG. 18B, the pressing member 54 is set into the posture capable of pressing the switching member 19. When the top cover 18 is closed in this state, the switching part 19*a* of the switching member 19 is pressed by the pressing member 54, closing of the top cover 18 is detected, and the cover printer 1 is set into an operation enable state.

In accordance with the above-described color printer 1 according to the embodiment of the disclosure, as shown in FIG. 17A, in a case where the rotation force transmission mechanism 40 is in the transmission state, that is, in a state in which the manual lever 51 is pressed down, the engagement of the intermediate transferring unit 5 with the locking member 52 cannot be released. That is, in the transmission state, the intermediate transferring unit 5 cannot be detached. Since the photosensitive drum 9 cannot be detached unless the intermediate transferring unit 5 is detached, detachment of the photosensitive drum 9 in the transmission state is prevented.

In other words, as long as the manual lever 51 is pulled up and then the rotation force transmission mechanism switches into the transmission release state, the photosensitive drum 9 cannot be detached. If the photosensitive drum 9 is tried to be detached prior to releasing the rotation force transmission, the joint member 42 or the like of the rotation force transmission mechanism 40 may be damaged; however, in the present disclosure, since the intermediate transferring unit 5 and the photosensitive drum 9 cannot be detached unless the rotation force transmission mechanism 40 is set in the transmission release state, the joint member 42 or the like can be prevented from being damaged.

Further, as shown in FIG. 19, it is constructed such that as long as a predetermined work is carried out in a predetermined order, the photosensitive drum 9 cannot be replaced and thus incorrect attachment and detachment of the photosensitive drum 9 can be prevented.

Also, as shown in FIG. 16, FIG. 18A and FIG. 18B, the attachment of the wire cover 53 makes it possible to displace the pressing member 54 into the posture capable of pressing the switching member 19 and to supply a rotation force to the rotation force transmission mechanism 40 unless the manual lever 51 switches the rotation force transmission mechanism 40 into the transmission state. Namely, in an abnormal actuation environment state, such as a state in which the rotation force transmission mechanism 40 is in the transmission release state, the rotation force transmission mechanism 40 can be made inactive.

Further, since one switching member 19 is compatible with detecting of an opening/closing state of the top cover 18 and preventing of actuation of the color printer 1 in the transmission release state, there is no need to provide a dedicated switch for each purpose, and cost reduction can be achieved.

Incidentally, the embodiment of the present disclosure is constructed such that the locking member 52 is configured to be engaged with the intermediate transferring unit 5 and to release the engagement, and the wire cover 53 and the pressing member 54 are configured to restrict the operations of the manual lever 51 and the switching member 19; however, the locking member 52, the wire cover 53 and the pressing member 54 have an effect for preventing incorrect attachment of the photosensitive drum 9 even if they are used separately. However, by using a combination thereof, in becomes possible to have an advantageous effect of preventing actuation of the color printer 1 in an abnormal actuation environment such as an environment where the rotation force transmission mechanism is in the transmission release state, in addition to an advantageous effect of more reliable preventing of incorrect attachment and detachment.

Although the embodiment of the disclosure shows the photosensitive drum 9 included in the image forming unit, the image forming unit includes the developing device 11 and the others addition to the photoconductive drum 9. If the developing device 11 has the same rotation force transmission mechanism as that of the photosensitive drum 9, the incorrect attachment and detachment preventing mechanism 50 mentioned above can be used together.

What is claimed is:

1. An image forming apparatus comprising:

an image forming unit attachable to or detachable from a predetermined position;

a rotation force transmission mechanism configured to transmit a rotation force from a driving source the image forming unit;

a manual lever configured to switch the rotation force transmission mechanism into a transmission state in which the rotation force transmission mechanism is coupled to the image forming unit and a transmission release state in which the rotation force transmission mechanism is spaced away from the image forming unit; and an incorrect attachment or detachment preventing mechanism configured to prevent attachment and detachment of the image forming unit in the transmission state, wherein the incorrect attachment and detachment preventing mechanism includes a locking member capable of moving to a restrict position where the locking member restricts movement of the image forming unit from the predetermined position and a permission position where the locking member permits movement of the image forming unit from the predetermined position, the manual lever is formed with a first engaging part configured to engage with the locking member at the restrict position and a second engaging part configured to engage with the locking member at the permission state; and when the manual lever switches the rotation force transmission mechanism into the transmission state, the locking member is configured to engage with the first engaging part of the manual lever at the restrict position to prevent movement of the image forming unit, and when the manual lever switches the rotation force transmission mechanism into the transmission release state, the locking member is configured to be moved to the permission position and then engaged with the second engaging part of the manual lever to permit movement of the image forming unit.

2. The image forming apparatus according to claim 1, wherein the locking member disables the rotation force transmission mechanism to be switched into the transmission state by the manual lever when engaged with the second engaging part of the manual lever.

3. The image forming apparatus according to claim 1, wherein the incorrect attachment and detachment preventing mechanism includes:

an attachable and detachable wire cover configured to protect a wire or the like connected to the image forming unit;

a switching member configured to be pressed and then to supply a rotation force from the driving source to the image forming unit via the rotation force transmission mechanism; and a pressing member configured to be displaced into a posture capable of pressing the switching member and another posture incapable of pressing the switching member, wherein the attachment of the wire cover displaces the pressing member into the posture capable of pressing the switching member.

4. The image forming apparatus according to claim 3, wherein the attachment of the wire cover disables the rotation force transmission mechanism to be switched into the transmission release state.

5. The image forming apparatus according to claim 3, wherein the switching member is configured to detect whether a space into which the image forming unit is attached is opened or closed with an opening/closing member.

6. The image forming apparatus according to claim 3, wherein the image forming unit is configured to be detached by detaching the wire cover and displacing the pressing member into the posture incapable of pressing the switching member, switching the rotation force transmission mechanism into the transmission release state by the manual lever to permit the movement of the locking member from the restrict position to the permission position, and by moving the locking member into the permission state.

7. The image forming apparatus according to claim 1, wherein the manual lever is movably supported in an upward and downward directions, and is configured to switch the rotation force transmission mechanism from the transmission state into the transmission release state by pulling up and moving upward, and to switch the rotation force transmission mechanism from the transmission release state to the transmission state by pulling down and moving downward.

8. The image forming apparatus according to claim 1, wherein the rotation force transmission mechanism is configured to coaxially couple a driving shaft provided at the image forming unit and a driving shaft of the driving source to each other by employing a joint member.

* * * * *